US011493030B2

(12) United States Patent
Singh

(10) Patent No.: US 11,493,030 B2
(45) Date of Patent: Nov. 8, 2022

(54) FLUID PUMPS WITH SHIFTERS

(71) Applicant: Hewlett-Packard Development Company, L.P., Spring, TX (US)

(72) Inventor: Kundan Singh, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 250 days.

(21) Appl. No.: 16/636,575

(22) PCT Filed: Aug. 11, 2017

(86) PCT No.: PCT/US2017/046538
§ 371 (c)(1),
(2) Date: Feb. 4, 2020

(87) PCT Pub. No.: WO2019/032120
PCT Pub. Date: Feb. 14, 2019

(65) Prior Publication Data

US 2021/0155005 A1 May 27, 2021

(51) Int. Cl.
*F04B 9/04* (2006.01)
*F04B 43/02* (2006.01)
*B41J 2/175* (2006.01)

(52) U.S. Cl.
CPC ..... *F04B 9/042* (2013.01); *B41J 2/17596* (2013.01); *F04B 43/02* (2013.01); *F04B 43/026* (2013.01); *B41P 2251/11* (2013.01)

(58) Field of Classification Search
CPC .... B41J 2/175; B41J 2/17566; B41J 2/17596; B41J 29/13; F04B 43/026; F04B 43/02; F04B 9/042; F04B 9/04; B41P 2251/11
See application file for complete search history.

(56) References Cited

U.S. PATENT DOCUMENTS 5,219,274 A 6/1993 Pawlowski et al.
5,380,164 A 1/1995 Fry et al.
6,312,116 B2 11/2001 Underwood et al.
7,033,007 B2 4/2006 Seethoo
(Continued)

FOREIGN PATENT DOCUMENTS

CN 1532401 A 9/2004
CN 101245770 A 8/2008
(Continued)

OTHER PUBLICATIONS

Ebay—Original JYY(B)-Y-10-1 Micro Diaphragm Dc 24v 3w Ink Pump for Inkjet Printers, Jun. 14, 2017~http://www.ebay.com/~ 5 pages.

*Primary Examiner* — An H Do
(74) *Attorney, Agent, or Firm* — Trop Pruner & Hu PC

(57) ABSTRACT

In an example, a fluid pump includes a shifter having a first end and pivotable about a second end, a cam rotatably engaged with the shifter, wherein the cam is to rotate about a cam shaft axis if the shifter pivots about the second end, a diaphragm fluidly engaged with a fluid cavity, a collar movable with a cam surface of the cam, wherein the collar is to compress the diaphragm so as to decrease the volume of the fluid cavity, a fluid inlet having a one-way inlet valve to only allow fluid into the fluid cavity, and a fluid outlet having a one-way outlet valve to only allow fluid out of the fluid cavity, wherein the one-way outlet valve is to allow fluid out of the fluid cavity upon the volume of the fluid cavity being decreased.

20 Claims, 8 Drawing Sheets

(56) References Cited

U.S. PATENT DOCUMENTS

| | | | |
|---|---|---|---|
| 8,132,898 | B2 | 3/2012 | Fukazawa et al. |
| 8,777,388 | B2 | 7/2014 | Borra et al. |
| 2002/0057972 | A1 | 5/2002 | Barinaga |
| 2002/0085936 | A1 | 7/2002 | Noriaki |

FOREIGN PATENT DOCUMENTS

| | | | |
|---|---|---|---|
| GB | 0350817 | A | 6/1931 |
| GB | 0358936 | A | 10/1931 |
| GB | 626777 | | 7/1949 |
| GB | 1222716 | A | 2/1971 |
| JP | S5446924 | U | 3/1979 |
| JP | S5573563 | A | 6/1980 |
| JP | S5981790 | U | 6/1984 |
| JP | 05-296149 | A | 11/1993 |
| RU | 488930 | A | 1/1976 |

FLUID PUMPS WITH SHIFTERS

BACKGROUND

Electronic devices such as imaging devices, for example, may perform operations on or with media, sometimes referred to as print media. Such operations may involve the use of a print fluid. In some situations, such print fluid may be pumped from one location within the electronic device to another location with the use of a fluid pump.

DETAILED DESCRIPTION

Electronic devices such as imaging devices, for example, may perform operations on or with media, sometimes referred to as print media, or a medium thereof. Such operations may be referred to as print operations, and may include printing, copying, scanning, plotting, or other types of operations using media. Such print operations may sometimes involve the use of a print substance or print fluid. In some situations, such print fluid may be disposed in one portion of the electronic device, while the print fluid may be used in print operations in another portion of the electronic device. Thus, the print fluid may be transported using plumbing, conduits, or other structure from one location within the electronic device to another location. In some situations, it may be beneficial to use a fluid pump to help transport the print fluid through such plumbing or other structure within the electronic device.

In some situations, a standard, "off-the-shelf," or commonly-used fluid pump, or a fluid pump having its own drive components, e.g., a motor and/or gear train, may be used in an electronic device to transport print fluid. Such types of fluid pumps may be relatively large, heavy, expensive, and/or occupy a larger-than-desired footprint or volume within the electronic device. Interior volume of such electronic devices is often at a premium, and minimizing size and/or weight of such electronic devices is often a priority or goal. Thus, such a standard or common type of fluid pump is often not desired for use in such an electronic device.

In some situations, it may be desirable to utilize a fluid pump within an electronic device wherein the fluid pump is relatively small, lightweight, and/or cheap. Further, it may be desirable that, instead of the fluid pump having its own dedicated drive components, the fluid pump be driven by existing motive components or motion of components already in use within the electronic device.

Implementations of the present disclosure provide a fluid pump for driving or transporting print fluid within an electronic device, for example, an imaging device. Examples of fluid pumps disclosed herein may be capable of being driven, actuated, or otherwise operated by existing components within the electronic device. Thus, the size, weight, and/or additional cost of example fluid pumps described herein, as well as the footprint or volume such example fluid pumps may occupy within an electronic device, may be minimized, thereby lowering the overall size, weight, and cost of the electronic device itself, and thus improving user experience.

Figure 1A:
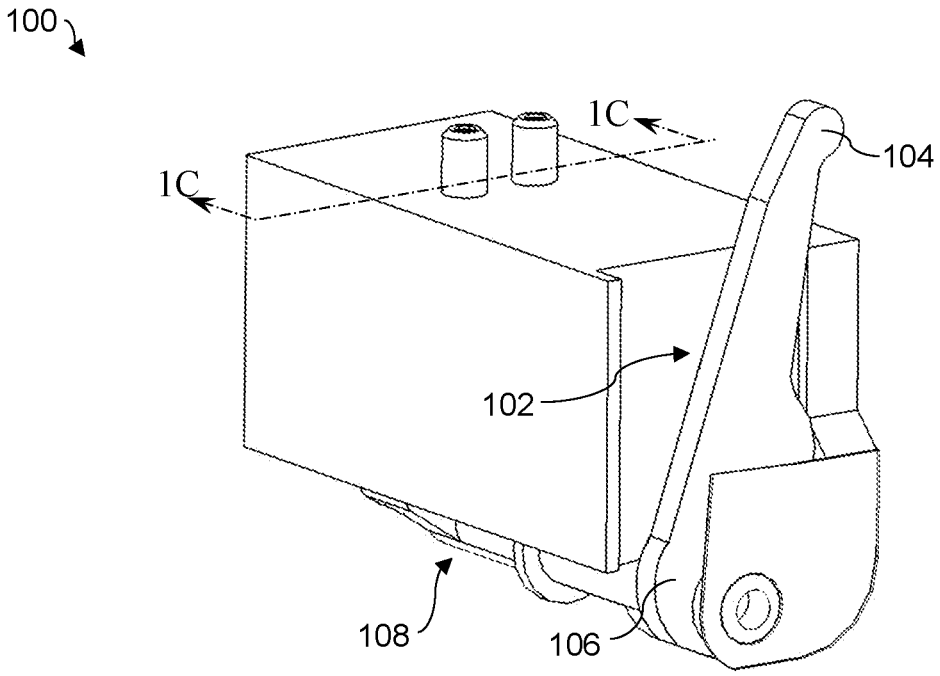
FIG. 1A is a perspective view of an example fluid pump.
Figure 1B:
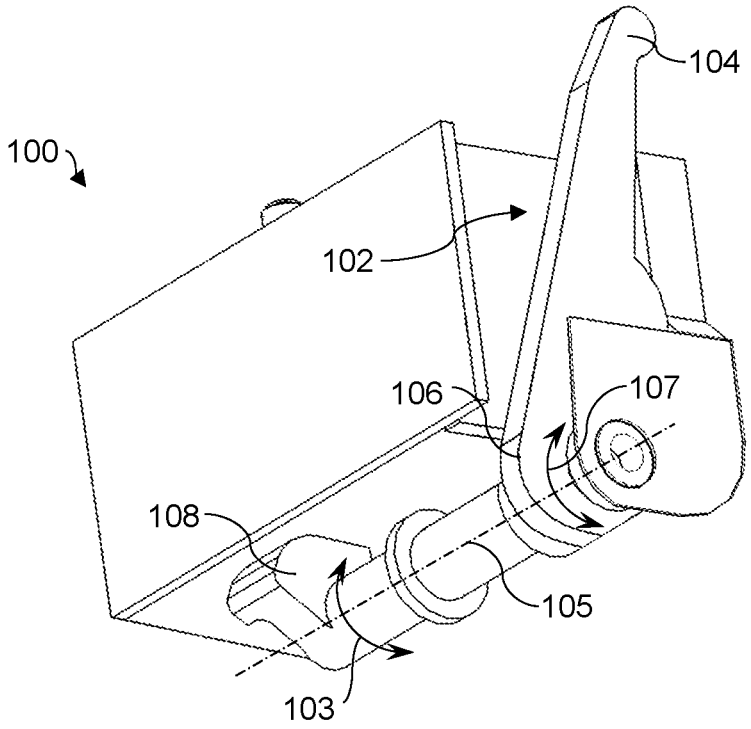
FIG. 1B is a perspective view of an example fluid pump.

Referring now to FIGS. 1A-1B, perspective views of an example fluid pump 100 are illustrated. Example fluid pump 100 may include a shifter 102 having a first end 104 and pivotable about a second end 106. The shifter 102 may be an elongate member having sufficient structure and strength to transfer a force exerted on the shifter 102, e.g., at the first end 104, into a rotation or pivot of the shifter 102 about the second end 106. Further, the fluid pump 100 may include a cam 108 rotatably engaged with the shifter 102, wherein the cam 108 is to rotate about a cam shaft axis 105, for example along direction 103, if the shifter 102 pivots about the second end 106, for example, along direction 107. In further implementations, the cam shaft axis 105 may be coaxial with an axis of rotation of the second end 106 of the shifter 102. In other words, the cam 108 and the shifter 102 may both rotate (along directions 103 and 107, respectively) about the cam shaft axis 105. In some implementations, the shifter 102 may be directly engaged with the cam 108, for example at the second end 106. In other implementations, the shifter 102 may be engaged with the cam 108 indirectly through intermediary components such as gears, shafts, belts, chains, or other transmission components. The cam 108 may have a cam surface (illustrated in FIG. 1C) which may be eccentric to, or having a variable or changing radial distance from, the cam shaft axis 105. Therefore, the cam 108, through the cam surface 108*a*, may push a component further away from the cam shaft axis 105 as the cam 108 is rotated about the cam shaft axis 105 in a first direction, and the cam 108 may allow the component to move closer to the cam shaft axis 105 as the cam 108 is rotated in a second direction, opposite to the first direction. In some implementations, the cam 108 may be fixed or attached to a cam shaft such that the cam 108 rotates with the cam shaft about the cam shaft axis 105.

Figure 1C:
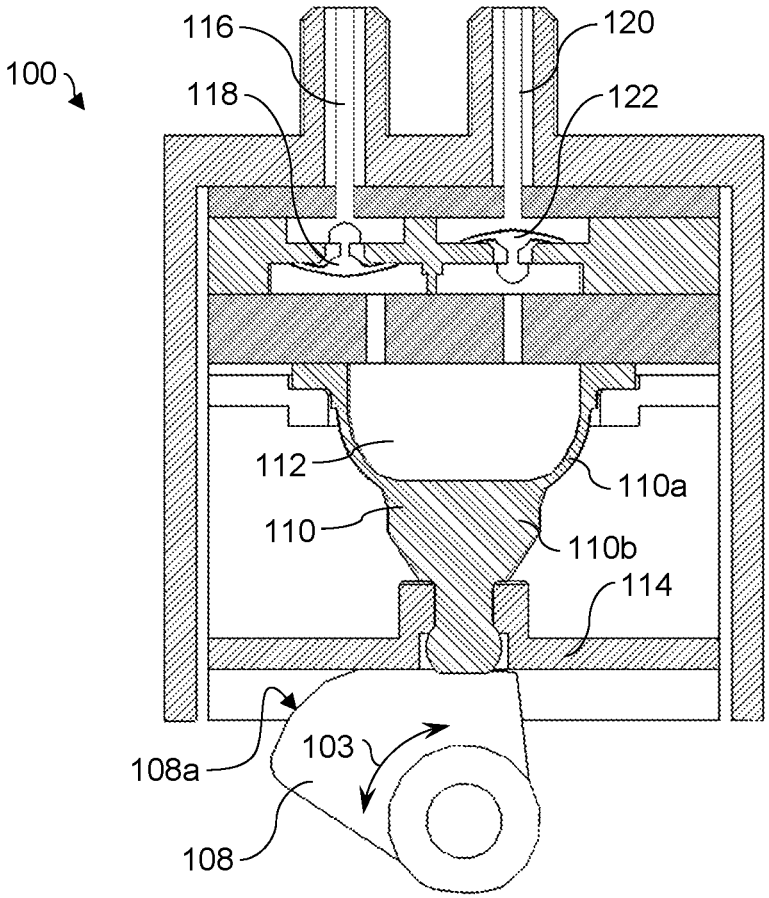
FIG. 1C is a cross-sectional view of an example fluid pump.

Referring additionally to FIG. 1C, a cross-sectional view taken along view line 1C-1C of FIG. 1A is illustrated. The example fluid pump 100 may further include a diaphragm 110 fluidly engaged with a fluid cavity 112, and a collar 114 movable with the cam surface 108*a* of the cam 108. The collar 114 may compress the diaphragm 110 so as to decrease a volume of the fluid cavity 112. The fluid cavity 112 may be an enclosed or semi-enclosed space, cavity, or volume suitable to receive and hold a fluid used in an electronic device, for example, print fluid. The diaphragm 110 may be a resilient component capable of returning to its original shape after undergoing a deformation. In other words, the diaphragm 110 may be elastically deformable. In some implementations, the diaphragm 110 may include a pliable material, such as a polymer or elastomer. In other implementations, the diaphragm 110 may include another material suitable to provide sufficiently elastic properties to the diaphragm 110. The diaphragm 110 may, at least partially, define the fluid cavity 112. As such, the diaphragm 110 may, in some implementations, include a concave structure or geometry. Further, the diaphragm 110 may include a membrane or thin-walled portion 110*a* that may deform under a pressing force from the collar 114 so as to decrease the volume of the fluid cavity 112. In some implementations, the fluid cavity 112 may be defined by the thin-walled portion 110*a*. In yet further implementations, the diaphragm 110 may include a base portion 110*b* that may engage with the collar 114. In some implementations, the base portion 110*b* may have a different structure or geometry than the thin-walled portion 110*a* such that the base portion 110*b* is less deformable than the thin-walled portion 110*a*.

The collar 114 may be a component with sufficient structure and/or strength to rigidly engage the diaphragm 110 with the cam 108. In some implementations, the collar 114 may be a plate or wall which may be movable in a direction towards the fluid cavity 112 from the cam 108. In further implementations, the collar 114 may be disposed in between the cam 108, or the cam surface 108*a* thereof, and the diaphragm 110, or the base portion 110*b* thereof. In yet further implementations, the collar 114 may mate with, attach to, or otherwise be engaged with the base portion 110*b* such that the collar 114 may press on the base portion 110*b* upon being moved in a direction towards the fluid cavity 112. Such pressing on the base portion 110*b* may cause the base portion 110*b* to, in turn, press on and elastically deform the thin-walled portion 110*a* so to decrease the volume of the fluid cavity 112. In further implementations, the cam surface 108*a* may press against a bottom surface of the collar 114, and the base portion 110*b* may be engaged with a top surface of the collar 114, opposite from the bottom surface.

The fluid pump 100 may further include a fluid inlet 116 having a one-way inlet valve 118 to only allow fluid into the fluid cavity 112, and a fluid outlet 120 having a one-way outlet valve 122 to only allow fluid out of the fluid cavity 112. The fluid inlet 116 and the fluid outlet 120 may both be conduits or plumbing which may be fluidly engaged with the fluid cavity 112. Further, the inlet valve 118 and the outlet valve 122 may be fluid valves that may be structured and oriented within the fluid inlet 116 and the fluid outlet 120, respectively, so as to only allow fluid such as print fluid to pass through the respective valve in one direction. In further implementations, the inlet valve 118 and/or the outlet valve 122 may be check valves, umbrella valves, or other types of one-way valves. As such, fluid may come in to the fluid inlet 116 and pass through the inlet valve 118 to enter the fluid cavity 112. Similarly, fluid may exit the fluid cavity 112 and pass through the outlet valve 122 to exit the fluid pump 100 through the fluid outlet 120. In some implementations, the one-way outlet valve 122 may allow fluid out of the fluid cavity 112 upon the volume of the fluid cavity 112 being decreased, e.g., by the diaphragm 110 contracting or being pushed or squeezed. Similarly, the one-way inlet valve 118 may allow fluid to pass through the inlet valve 118 and into the fluid cavity 112 upon the volume of the fluid cavity 112 being increased, e.g., by the diaphragm 110 expanding back to its original shape.

Figure 1D:
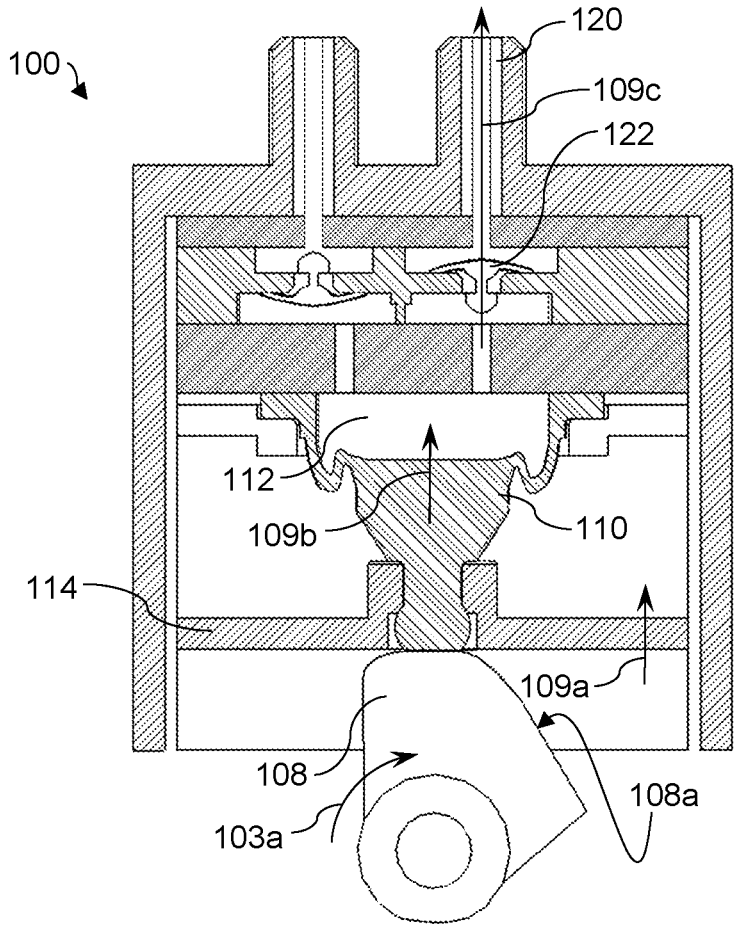
FIG. 1D is a detail cross-sectional view of an example fluid pump.

Referring additionally to FIG. 1D, a cross-sectional view of the example fluid pump 100 is illustrated wherein the cam 108 has been rotated about the cam shaft axis 105 along direction 103*a*. In some implementations, the cam 108 has been rotated due to the shifter 102 receiving a force so as to pivot about the second end 106. The cam surface 108*a* of the cam 108 has pressed against the collar 114, or a bottom surface thereof, throughout the rotation of the cam 108 so as to push and move the collar 114 in a direction 109*a*, which may be referred to as an actuation direction, towards the diaphragm 110. Correspondingly, the collar 114, through its engagement with the diaphragm 110, has pushed the diaphragm 110 in a similar direction 109*b* so as to squeeze, crush, or otherwise deform the diaphragm 110. In some implementations, the thin-walled portion of the diaphragm 110 has deformed so as to result in the deformation of the diaphragm 110. The diaphragm 110 has been deformed to a sufficient degree so as to decrease the volume of the fluid cavity 112, thereby increasing the fluid pressure within the fluid cavity 112 and causing the fluid within to press against the outlet valve 122 to actuate the outlet valve 122 such that the fluid within the fluid cavity 112 is able to pass through the outlet valve 122 and out of the fluid outlet 120, represented by arrow 109*c*. In other implementations, the outlet valve 122 may be actuated by another mechanism, for example, the outlet valve 122 may be electronically or magnetically actuated.

Figure 1E:
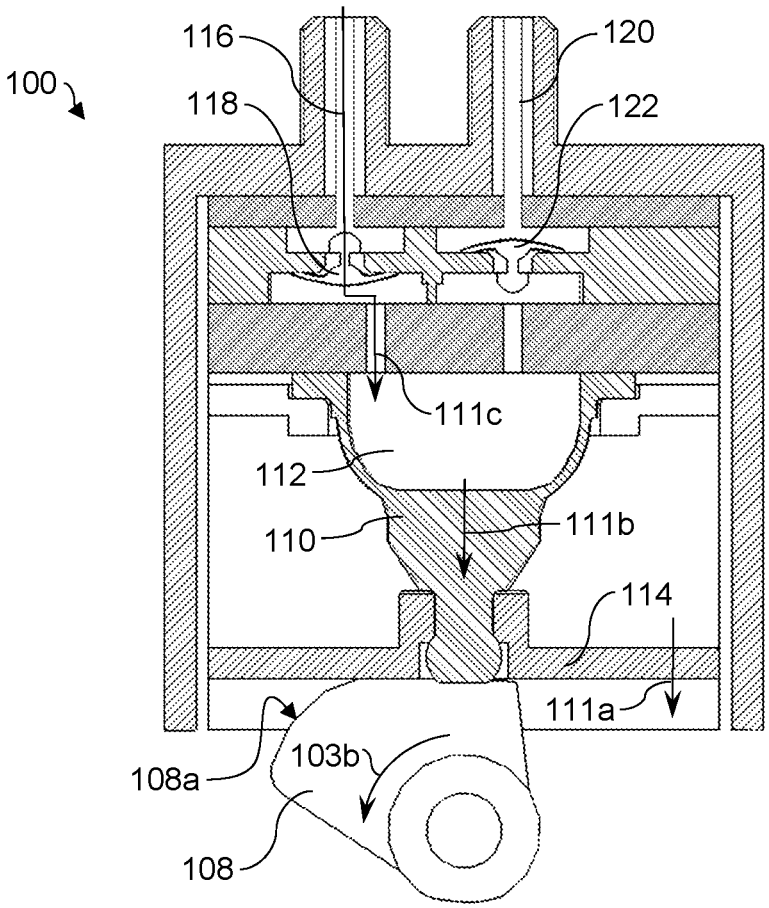
FIG. 1E is a cross-sectional view of an example fluid pump.

Referring now to FIG. 1E, a cross-sectional view of the example fluid pump 100 is illustrated wherein the cam 108 has been reset, or rotated back about the cam shaft axis 105 along direction 103*b*, which may be opposite to direction 103*a*. In some implementations, the cam 108 has been rotated along direction 103*b* due to the shifter 102 receiving a force so as to pivot about the second end 106 in an opposite manner than as described with reference to FIG. 1D. The cam surface 108*a* of the cam 108 has stopped pressing against the collar 114, or a bottom surface thereof, throughout the rotation of the cam 108 along 103*b* or otherwise allowed the collar 114 to fall back or move in a direction away from the diaphragm 110 and the fluid cavity 112, for example along direction 111*a*, towards the cam 108 and/or the cam shaft axis 105. Correspondingly, the collar 114 has stopped pushing on the diaphragm 110 so as to allow the diaphragm 110, or the thin-walled portion thereof, to elastically expand and/or return to its original shape along a similar direction 111*b*. The diaphragm 110 has expanded to a sufficient degree so as to increase the volume of the fluid cavity 112, thereby decreasing the fluid pressure within the fluid cavity 112 and allowing fluid within the fluid inlet 116 to press against the inlet valve 118 to actuate the inlet valve 118 such that the fluid within the fluid inlet 116 is able to pass through the inlet valve 118 and into the fluid cavity 112, represented by arrow 111*c*. In other implementations, the inlet valve 118 may be actuated by another mechanism, for example, the inlet valve 118 may be electronically or magnetically actuated.

Stated differently, the fluid pump 100 may evacuate the fluid cavity 112 by the cam 108 rotating in a first direction to push the collar 114 to squeeze the diaphragm 110 to push fluid contained within the fluid cavity 112 through the outlet valve 122 and out of the fluid outlet 120. Further, the fluid pump 100 may refill the fluid cavity 112 or draw fluid into the fluid cavity 112 by the cam 108 rotating back in a second direction to allow the diaphragm 110 to expand and return to its original shape, moving the collar 114 back down concurrently. The expansion of the diaphragm 110, and thus the fluid cavity 112, decreases the pressure within the fluid cavity 112 so as to allow the inlet valve 118 to open, thereby drawing fluid in the fluid inlet 116 through the inlet valve 118 and into the fluid cavity 112. After the fluid cavity 112 has been filled with fluid once again, the whole process may repeat, thus pumping fluid throughout an electronic device, or a portion thereof. In some implementations, a reciprocating force exerted against the shifter 102 may cause a reciprocating pumping action of the fluid pump 100.

Figure 2:
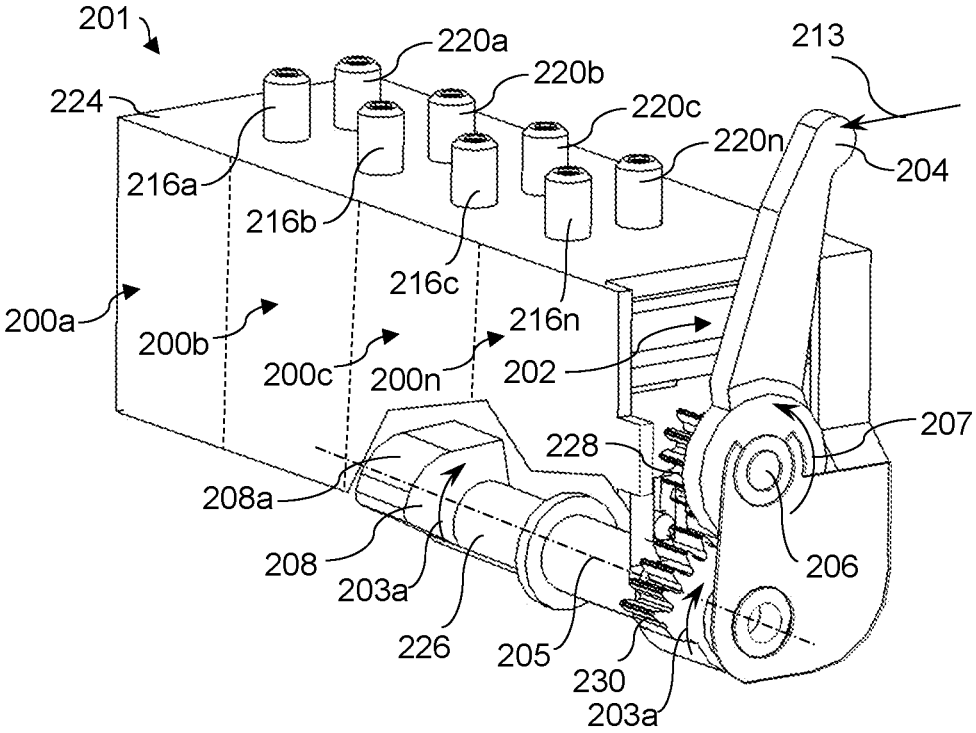
FIG. 2 is a perspective view of an example multi-channel fluid pump.

Referring now to FIG. 2, a perspective view of an example multi-channel fluid pump 201 is illustrated. The example multi-channel fluid pump 201 may include a pump housing 224 and a plurality of pump channels 200*a*, 200*b*, 200*c* . . . 200*n* (referred to collectively as pump channels 200), which may be disposed, at least partially, within the pump housing 224. Example pump channels 200 may be similar to fluid pumps described above, e.g., fluid pump 100. Further, the similarly-named elements of example pump channels 200 may be similar in function and/or structure to the respective elements of example fluid pumps, as they are described above. Each of the example pump channels 200 may disposed within the pump housing 224 so as to be hidden in FIG. 2. As such, each of the pump channels 200*a*, 200*b*, 200*c* . . . 200*n* are illustrated approximately as being separated by dotted construction lines in FIG. 2. In some implementations, the plurality of pump channels may have four pump channels 200. In other implementations, the multi-channel fluid pump 201 may have more or fewer pump channels 200.

Each pump channel 200 of the plurality of pump channels 200 may include a fluid inlet 216 and a fluid outlet 220 (illustrated as fluid inlets 216*a* . . . 216*n*, and fluid outlets 220*a* . . . 220*n*). Each fluid inlet 216 may have a one-way inlet valve and each fluid outlet 220 may have a one-way outlet valve, as described above. Each pump channel 200 may also include a diaphragm having or at least partially defining a fluid cavity in fluid communication with the respective fluid inlet 216 and fluid outlet 220.

The multi-channel fluid pump 201 may include a shifter 202 having a first end 204 extending from the pump housing 224 and a second end 206, about which the shifter 202 may be rotatable or pivotable. In some implementations, the first end 204 may receive a linear force 213 to cause the shifter to rotate about the second end 206. In other implementations, the shifter 202 may receive a linear force and/or another type of force, such as a torque, and may receive such forces at a location other than the first end 204, as long as the location is suitable to transfer the force into a rotational movement of the shifter 202 about the second end 206. In some implementations, the shifter 202, or the first end 204 thereof, may receive the linear force externally from the pump housing 224. Thus, the shifter 202 may be moved or actuated by another component or motive force within an electronic device within which the multi-channel fluid pump 201 may be disposed or employed.

The multi-channel fluid pump 201 may further include a cam 208 fixed to a cam shaft 226 and having a cam surface 208*a*. The cam shaft 226 may extend along the pump housing 224 and may be rotatably engaged with the shifter 202 such that a rotation of the shifter 202 about the second end 206 may be transferred into a rotation of the cam shaft 226 about a cam shaft axis 205. The cam shaft axis 205 may be substantially parallel to an axis of rotation of the second end, in some implementations. The multi-channel fluid pump 201 may also have a collar (not shown) that may be movable with the cam surface 208*a* of the cam 208. In further implementations, the collar may be disposed so as to actuate each of the diaphragms of the pump channels 200 upon the collar moving with the cam surface 208*a* of the cam 208. In other words, the collar may move with the cam surface 208*a* so as to actuate each pump channel 200 by compressing each diaphragm of the plurality of pump channels 200 so as to decrease the volume of each fluid cavity. Thus, in such an implementation, the plurality of pump channels 200 may be arranged in an array that is substantially parallel to the cam shaft 226 so that the cam 208 may press against the collar in a sufficient manner so as to actuate each of the pump channels 200. In other implementations, each pump channel 200 of the plurality of pump channels 200 may have its own discrete collar that is individually pushed on by a separate, discrete cam disposed along the cam shaft 224. Stated differently, upon receiving an external force 213, the shifter 202 may turn the cam 208 so as to push on the collar and actuate the plurality of pump channels 200 so as to cause each pump channel 200 to pump fluid out of the respective fluid outlet 220.

In some implementations, the cam shaft axis 205 may not be coaxial with an axis of rotation of the second end 206 of the shifter 202. In other words, the shifter 202 may be indirectly engaged with the cam shaft 226 through intermediary components. In some implementations, the second end 206 of the shifter 202 may have a shifter gear 228 to operably engage with a cam gear 230 disposed about the cam shaft axis 205. The shifter gear 228 may operably mesh and engage with the cam gear 230 such that a rotation of the shifter gear 228 is transferred to an opposite but corresponding rotation of the cam gear 230. In other words, the shifter 202 may receive a force 213, which may be a linear force, which may cause the shifter 202 to pivot or rotate about the second end along direction 207. Such a rotational movement may be transferred by the shifter gear 228 to the cam gear 230 to cause the cam shaft 226, and thus the cam 208 to rotate along corresponding and opposite direction 203*a*. Further, while illustrated as gears with complementary and meshing teeth, the shifter gear 228 and/or the cam gear 230 may be other types of transmission components suitable for transmitting rotational motion and torque. For example, in other implementations, the shifter gear 228 and the cam gear 230 may be friction wheels.

Figure 3A:
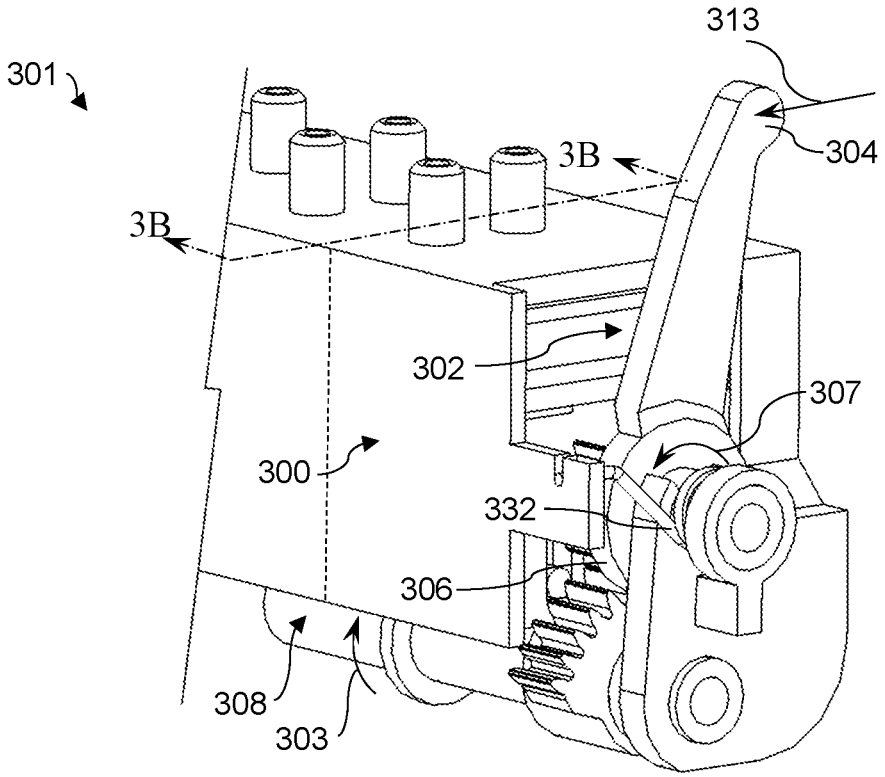
FIG. 3A is a perspective view of an example multi-channel fluid pump.

Referring now to FIG. 3A, a partial perspective view of an example multi-channel fluid pump 301 is illustrated. Example multi-channel fluid pump 301 may be similar to other multi-channel fluid pumps described above. Further, the similarly-named elements of example multi-channel fluid pump 301 may be similar in function and/or structure to the respective elements of other example multi-channel fluid pumps, as they are described above. In some implementations, the multi-channel fluid pump 301 may include a plurality of pump channels 300, which may be similar in structure and function to pump channels 200, and/or fluid pump 100, described above. Multi-channel fluid pump 301 may include a shifter 302, which may receive a linear, external force 313 (for example, at a first end 304), causing the shifter 302 to pivot along example direction 307. The pivoting and rotation of shifter 302 may cause a cam 308 to rotate in a corresponding manner, represented by example direction 303. The cam 308 may push on and actuate a collar, which may actuate a diaphragm of each of the pump channels 300 to cause each pump channel 300 to pump fluid. Additionally, the multi-channel fluid pump 301 may include a bias member 332 to bias and/or urge the first end 304 of the shifter 302 in a direction opposite to a direction from which the shifter 302, or the first end 304 thereof, may receive the external force 313. In other words, the bias member 332 may be structured and oriented so as to resist the movement of the shifter 302 caused by the external force 313. Thus, the external force 313 may cause the shifter 302 to move in the illustrated fashion, but when the external force 313 is removed or sufficiently lessened, the bias member 332 may move the shifter 302 back to where it started before the external force 313 was applied. In some implementations, the bias member 332 is a spring, capable of undergoing elastic deformation. In further implementations, the bias member 332 may be a torsion spring, and in yet other implementations, the bias member 332 may be another type of spring.

Figure 3B:
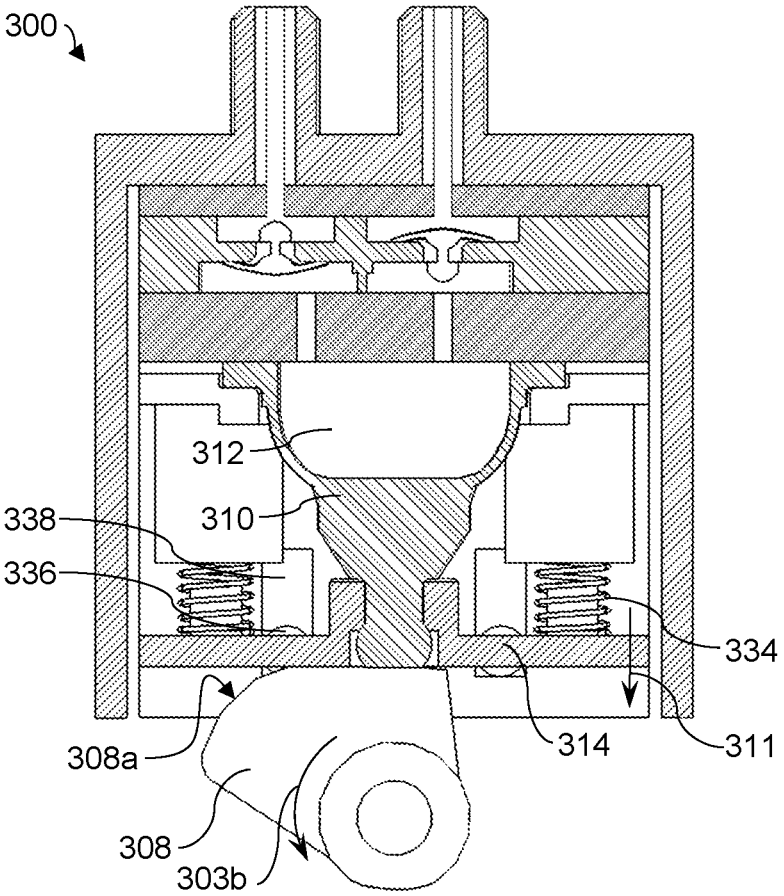
FIG. 3B is a cross-sectional view of an example multi-channel fluid pump.

Referring additionally to FIG. 3B, a cross-sectional view taken along view line 3B-3B of FIG. 3A of an example pump channel 300 of the example multi-channel fluid pump 301 is illustrated. In some examples, each pump channel 300 may include a diaphragm 310 defining a fluid cavity 312, as described above. In some implementations, each pump channel 300 may also include one or multiple reset bias members 334 disposed in between a collar 314 and a housing or other fixed portion of the multi-channel fluid pump 301. After the pump channel 300 is actuated by the cam 308 and pumps fluid out of the fluid outlet as described above, the cam 308 may rotate along direction 303*b* to reset, which, in some implementations, may be caused by bias member 332 pushing the shifter 302 back to its starting position. As the cam 308 rotates along direction 303*b*, the reset bias members 334 may bias or urge the collar 314 along direction 311 so that the collar is constantly pressed against the cam 308, or a cam surface 308*a* thereof. The collar 314 may also be engaged with the diaphragm 310 of each pump channel 300 so as to capture a portion of each diaphragm 310. Thus, as the collar 314 is pushed along direction 311, the collar 314 may also pull on each diaphragm 310 so as to expand the diaphragm 310, and thus the fluid cavity 312, pulling more fluid back into the fluid cavity 312. Therefore, after each pump channel 300 pumps fluid out of the fluid outlet, the shifter 302 may rotate so as to allow the cam 308 to reset, and the reset bias members 334 may work in conjunction with the elastic and resilient properties of each diaphragm 310 in order to expand each diaphragm 310 to its original shape to pull in more fluid into the fluid cavity 312.

In some implementations, the multi-channel fluid pump 301, or the pump channels 300 thereof, may include one or multiple guide slots 338 and guide pins 336. Such guide slots 338 and guide pins 336 may assist in the smooth functioning and actuation of each pump channel 300. Specifically, in some implementations, the guide slots 338 and the guide pins 336 may help the collar 314 move through its range of motion smoothly and consistently.

Figure 4A:
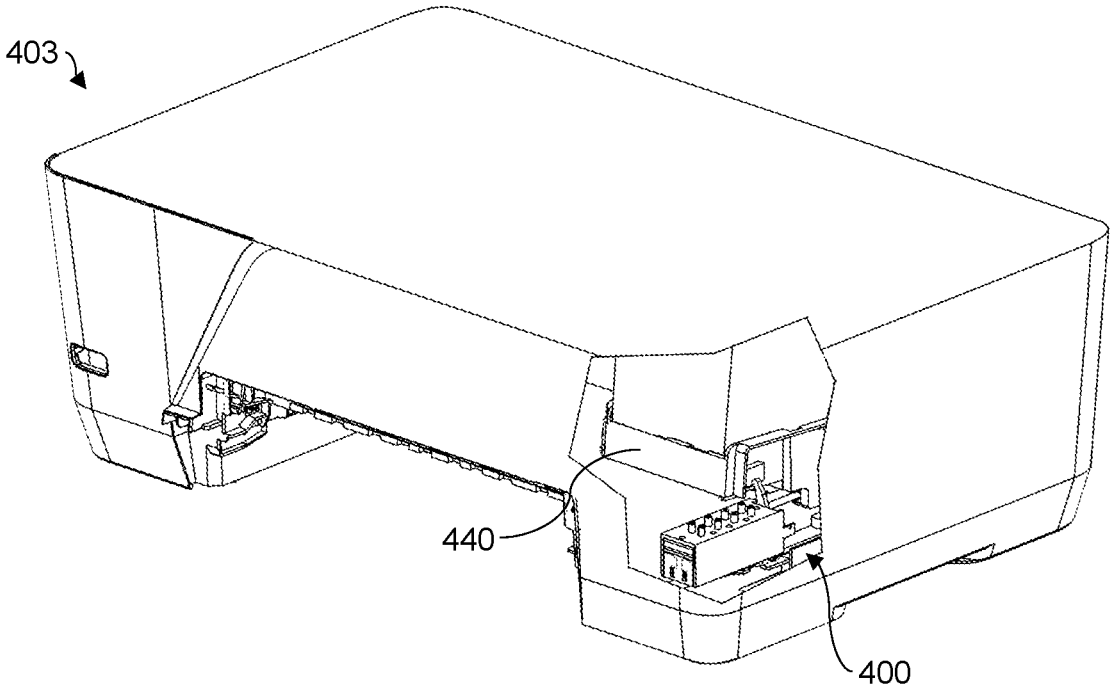
FIG. 4A is a cutaway perspective view of an example electronic device having an example fluid pump.
Figure 4B:
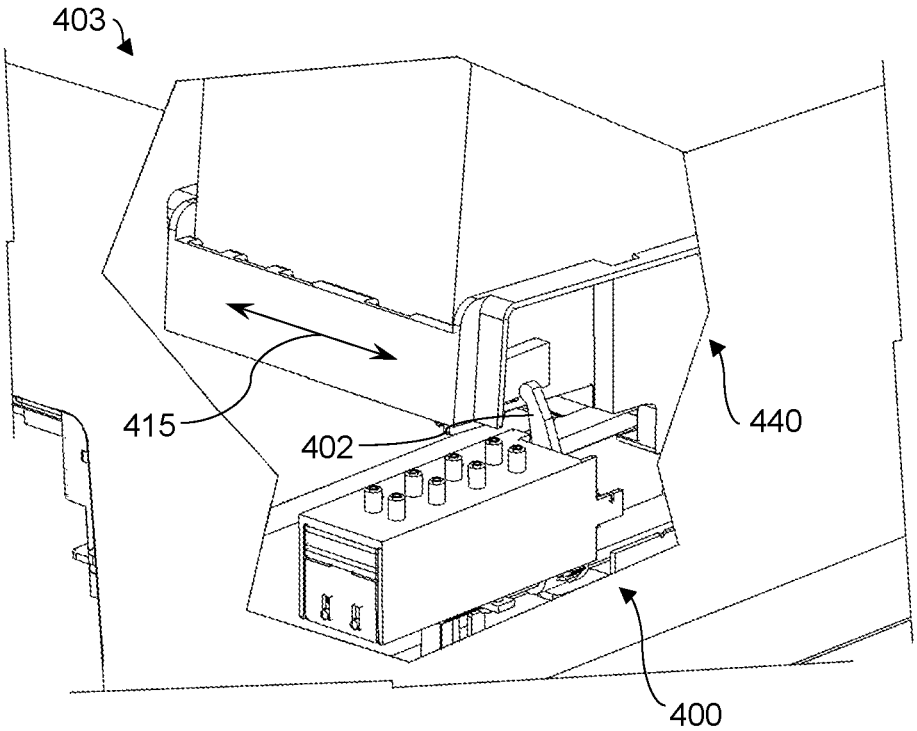
FIG. 4B is a perspective detail view of an example electronic device having an example fluid pump.

Referring now to FIGS. 4A-4B, a perspective view and a detail cutaway view of an example electronic device 403 having an example fluid pump 400 are illustrated. In some implementations, the electronic device 403 may have an example multi-channel fluid pump. The fluid pump 400, or the multi-channel fluid pump, and like-named elements thereof, may be similar in structure and/or function to other fluid pumps and multi-channel fluid pumps and their constituent components described above.

The electronic device 403 may be an imaging device in some implementations, for example, a printer, scanner, copier, or another type of imaging device. In other implementations, the electronic device 403 may be another type of electronic device which may benefit from having a fluid pump. In some implementations, the electronic device 403 may perform operations on or with media, sometimes referred to as print media. The electronic device 403 may perform such operations, which may sometimes be print operations, using a substance such as a fluid, which may be a liquid in some situations. In further implementations, the fluid may be a print fluid, and may be a substance such as ink. In further implementations, the fluid may be disposed in one portion of the electronic device 403 and may be transported to another portion of the electronic device 403, for example to be used during operations or print operations. In yet further implementations, the fluid may be ink and may be disposed or stored remotely from a printhead or other device which may utilize the ink. Thus, the example fluid pump 400 may assist in transporting such fluid throughout or through a portion of the electronic device 403.

The electronic device 403 may also have a motive component 440 which may move within the electronic device 403. In some implementations, the motive component 440 may be a carriage and may have or receive a printhead, print cartridge, or other component for use in the electronic device 403. In some implementations, the motive component 440 may move in a manner similar to example direction 415. In implementations wherein the motive component 440 is a carriage, the carriage may move along a carriage path within the electronic device 403, which may be represented by example direction 415. Further, the motive component 440 may be disposed near a shifter 402 of the fluid pump 400, or a first end thereof, such that the motive component may engage with the shifter 402 throughout at least a portion of the movement of the motive component. The motive component 440 may engage with the shifter 402 so as to cause the shifter 402 to move. In other words, the shifter 402 may receive a linear force, external to the fluid pump 400, to cause the shifter 402 to rotate about a second end and actuate the fluid pump 400. In implementations wherein the motive component 440 is a carriage, the movement of the carriage along the carriage path may transfer the linear force to the first end of the shifter 402. Thus, the existing movement of the motive component 440 within the electronic device 403 may actuate the fluid pump 400 and cause the fluid pump 400 to pump or transport fluid through the electronic device 403, without the need for a supplemental or dedicated pump motor. In further implementations, the motive component 440 may repeatedly engage with the shifter 402 so as to cause the shifter 402 to reciprocate, thereby causing the fluid pump 400 to pump fluid repeatedly.

What is claimed is:

1. A fluid pump, comprising:

a shifter having a first end and pivotable about a second end, wherein the shifter is to pivot about the second end responsive to the first end receiving a linear force;

a spring to bias the first end of the shifter in a direction opposite to a direction from which the first end receives the linear force;

a cam rotatably engaged with the shifter, the cam to rotate about a cam shaft axis responsive to the shifter pivoting about the second end;

a diaphragm fluidly engaged with a fluid cavity;

a collar movable with a cam surface of the cam, the collar to compress the diaphragm so as to decrease a volume of the fluid cavity;

a fluid inlet having a one-way inlet valve to only allow fluid into the fluid cavity; and a fluid outlet having a one-way outlet valve to only allow fluid out of the fluid cavity, the one-way outlet valve to allow fluid out of the fluid cavity upon the volume of the fluid cavity being decreased.

2. The fluid pump of claim 1, wherein the diaphragm comprises:

a thin-walled portion to deform under a pressing force from the collar, and a base portion that engages the collar.

3. The fluid pump of claim 2, wherein after compression of the diaphragm from an initial shape to a compressed shape by the collar, the thin-walled portion of the diaphragm is to elastically expand the diaphragm from the compressed shape to the initial shape responsive to the collar moving away from the base portion of the diaphragm.

4. The fluid pump of claim 1, wherein the cam shaft axis is coaxial with an axis of rotation of the second end of the shifter.

5. The fluid pump of claim 1, wherein the cam shaft axis is not coaxial with an axis of rotation of the second end of the shifter, and wherein the second end of the shifter comprises a shifter gear to operably engage with a cam gear disposed about the cam shaft axis.

6. The fluid pump of claim 1, wherein the one-way inlet valve and the one-way outlet valve are check valves.

7. The fluid pump of claim 1, wherein the cam surface is eccentric and has a variable radial distance from the cam shaft axis.

8. A multi-channel fluid pump, comprising:

a pump housing;

a shifter having a first end extending from the pump housing and a second end, the first end to receive a linear force to cause the shifter to rotate about the second end;

a cam shaft rotatably engaged with the shifter and extending along the pump housing;

a cam fixed to the cam shaft, the cam having a cam surface;

a collar movable with the cam surface; and a plurality of pump channels, each pump channel comprising:

a diaphragm at least partially defining a fluid cavity;

a fluid inlet having a one-way inlet valve to only allow fluid into the fluid cavity; and a fluid outlet having a one-way outlet valve to only allow fluid out of the fluid cavity, wherein the collar is to move with the cam surface so as to compress each diaphragm of the plurality of pump channels so as to decrease a volume of each fluid cavity.

9. The multi-channel fluid pump of claim 8, wherein the cam shaft is to rotate about a cam shaft axis responsive to the shifter rotating about the second end, and the cam shaft axis is substantially parallel to an axis of rotation of the second end.

10. The multi-channel fluid pump of claim 9, wherein the plurality of pump channels are arranged in an array that is substantially parallel to the cam shaft axis.

11. The multi-channel fluid pump of claim 9, wherein the plurality of pump channels comprises four pump channels.

12. The multi-channel fluid pump of claim 9, wherein the first end of the shifter is to receive the linear force externally from the pump housing.

13. The multi-channel fluid pump of claim 8, comprising:

a spring to bias the first end of the shifter in a direction opposite to a direction from which the first end receives the linear force.

14. The multi-channel fluid pump of claim 8, wherein the diaphragm of each pump channel of the plurality of pump channels comprises:

a thin-walled portion to deform under a pressing force from the collar, and a base portion that engages the collar.

15. The multi-channel fluid pump of claim 14, wherein after compression of the diaphragm of each pump channel from an initial shape to a compressed shape by the collar, the thin-walled portion of the diaphragm is to elastically expand the diaphragm from the compressed shape to the initial shape responsive to the collar moving away from the base portion of the diaphragm.

16. An imaging device, comprising:

a carriage to move along a carriage path within the imaging device; and a multi-channel fluid pump, comprising:

a pump housing disposed within the imaging device;

a shifter having a first end and a second end, the first end extending from the pump housing to receive a linear force from the carriage to cause the shifter to rotate about the second end;

a cam shaft rotatably engaged with the shifter and having a cam with a cam surface, the cam and cam surface to rotate about a cam shaft axis responsive to the shifter rotating about the second end;

a collar engaged with the cam surface and movable along an actuation direction upon responsive to the cam surface rotating about the cam shaft axis; and a plurality of pump channels, each pump channel comprising:

a diaphragm at least partially defining a fluid cavity;

a fluid inlet having a one-way inlet valve to only allow fluid into the fluid cavity; and a fluid outlet having a one-way outlet valve to only allow fluid out of the fluid cavity, wherein the collar is to move along the actuation direction so as to compress each diaphragm of the plurality of pump channels so as to decrease a volume of each fluid cavity.

17. The imaging device of claim 16, wherein the first end of the shifter is engaged with the carriage such that the movement of the carriage along the carriage path transfers the linear force to the first end.

18. The imaging device of claim 17, further comprising a spring to bias the first end of the shifter against the movement of the carriage along the carriage path.

19. The imaging device of claim 16, wherein the multi-channel fluid pump is to pump ink through at least a portion of the imaging device.

20. The imaging device of claim 16, wherein the diaphragm of each pump channel of the plurality of pump channels comprises:

a thin-walled portion to deform under a pressing force from the collar, and a base portion that engages the collar, wherein after compression of the diaphragm of each pump channel from an initial shape to a compressed shape by the collar, the thin-walled portion of the diaphragm is to elastically expand the diaphragm from the compressed shape to the initial shape responsive to the collar moving away from the base portion of the diaphragm.

* * * * *